US006779874B2

(12) United States Patent
Sturgeon et al.

(10) Patent No.: US 6,779,874 B2
(45) Date of Patent: Aug. 24, 2004

(54) DEVICE FOR ENSURING PROPER TOE-HEEL INSTALLATION OF A DETACHABLE PRINTER COMPONENT

(75) Inventors: Scott D. Sturgeon, Vancouver, WA (US); David C. Johnson, Portland, OR (US); Lisa M. Hanson, Vancouver, WA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 09/919,733

(22) Filed: Jul. 31, 2001

(65) Prior Publication Data

US 2003/0025764 A1 Feb. 6, 2003

(51) Int. Cl.[7] ..... B41J 2/01
(52) U.S. Cl. ..... 347/49
(58) Field of Search ..... 347/49, 50, 85–87

(56) References Cited

U.S. PATENT DOCUMENTS

| | | | | |
|---|---|---|---|---|
| 4,907,018 A | * | 3/1990 | Pinkerpell et al. | 346/139 R |
| 5,408,746 A | * | 4/1995 | Thoman et al. | 29/890.1 |
| 5,563,638 A | | 10/1996 | Osborne | |
| 5,619,239 A | * | 4/1997 | Kotaki et al. | 347/86 |
| 5,621,441 A | | 4/1997 | Waschhauser et al. | |
| 5,646,665 A | * | 7/1997 | Swanson et al. | 347/87 |
| 5,684,518 A | | 11/1997 | Nobel et al. | |
| 5,949,459 A | | 9/1999 | Gasvoda et al. | |
| 6,050,667 A | | 4/2000 | Yamada | |
| 6,139,135 A | | 10/2000 | Becker et al. | |
| 6,183,077 B1 | | 2/2001 | Hmelar et al. | |
| 6,203,135 B1 | | 3/2001 | Murcia et al. | |
| 6,209,983 B1 | | 4/2001 | Osborne et al. | |
| 6,443,567 B1 | * | 9/2002 | Hayashi et al. | 347/85 |

FOREIGN PATENT DOCUMENTS

| | | |
|---|---|---|
| EP | 0756937 A2 | 7/1996 |
| EP | 0818314 A2 | 1/1998 |
| EP | 1053875 A1 | 11/2000 |

OTHER PUBLICATIONS

European Search Report Dated Oct. 28, 2002 for related EPO application No. EP02255027.1.

* cited by examiner

*Primary Examiner*—Michael Nghiem

(57) ABSTRACT

A partial mounting portion cover that extends above and partially over the front portion of a chamber for operably receiving a detachable printer component therein. The cover includes a substantially planar top surface positioned over the toe-end of the detachable printer component when the printer component is fully installed on the mounting portion, such that the cover extends over the printer component only by an amount that precludes the cover from interfering with a toe-heel installation process. Accordingly, so long as the installer mounts the toe-end of the detachable printer component first, the mounting portion cover does not interfere with the installation. However, if an installer attempts to install the printer component in another manner, the cover blocks the toe-end of the printer component from entering the chamber, thereby alerting the installer of the improper installation method. In a preferred embodiment, the cover is pivotally secured to the mounting portion, biased to a neutral position, and has a visually distinguishable color from the mounting portion.

16 Claims, 7 Drawing Sheets

118
112
120
160b
50
24b
180
52
110
10
64
56
70
116
122b
60
98
32
32d
108
68
11
66
30
128

DEVICE FOR ENSURING PROPER TOE-HEEL INSTALLATION OF A DETACHABLE PRINTER COMPONENT

TECHNICAL FIELD

This invention relates to inkjet printing mechanisms, and more particularly, to a mounting portion partial cover for ensuring that a proper toe-heel installation process is used to secure a detachable printer component to its respective mounting portion on the printer.

BACKGROUND OF THE INVENTION

An ink-jet printer produces images and text on a page by firing drops of ink from the printheads of one or more ink cartridges while the cartridges move back and forth across the page. Examples of ink-jet printers include plotters, facsimile machines, and typical computer-attached ink-jet printers. The page on which a printer prints may be any sheet of material, such as paper, Mylar, foils, transparencies, card stock, etc.

The ink supply of an ink-jet printer is limited. Thus, many cartridges are designed to be detachably secured and replaceable. A user simply replaces the old, empty ink cartridge with a new, full ink cartridge. In these so-called cartridge-type printers, the cartridges can be manufactured as a unit that includes a printhead and an ink reservoir (referred to as an "ink/printhead cartridge" herein). Thus, these types of ink/printhead cartridges are seated in a carriage that travels back and forth across the page during printing operation.

Alternatively, in some designs commonly known as off-axis printers, the ink reservoir is a container that may be disconnected from the printhead, which remains installed on the carriage while the container is replaced. In the typical off-axis printer, only a printhead moves across the page, while the ink reservoir is stationary and secured to the base of the printer. Ink is delivered to an inlet port in the printhead via a flexible, ink delivery tube that extends from the stationary ink reservoir. Typically, the ink reservoir is mounted to the printer chassis and may be replaced or refilled when empty. Off-axis printers may be equipped either with a single printhead for monochromatic printing, or with several printheads for color printing. Of course, for color printing, several reservoirs and associated tubes are required, with one set used for each color.

In the ink-delivery systems of off-axis printers, the ink-delivery tube may be permanently connected to the printhead, but this would prevent replacement of the printhead. The printhead may suffer mechanical breakdown or simply wear-out after firing millions of drops of ink. Therefore, the printheads of a typical ink-jet printer are designed to be replaced, as necessary. Similarly, the supply of ink in reservoirs or containers used in cartridge-type or off-axis type printers may be replenished in refill stations that are peripheral components of the printer system.

Irrespective of the nature of the removable ink-jet printer component (ink cartridge, reservoir or printhead, for example), it is desirable to ensure that those components are accurately connected in the printer. That is, a component such as an ink/printhead cartridge must be properly seated in the carriage. This proper seating and positioning requirement also applies to off-axis printers, especially where several reservoirs and associated ink-delivery tubes are involved.

In the past, various mechanical latches, datum features, and/or electrical identification techniques have been employed for ensuring that a replaceable printer component, such as an ink/printhead cartridge, ink reservoir, or printhead, is operably installed in the correct location in the printer. For example, the replaceable printer component may include a unique pattern of tabs for operably engaging appropriate recesses in the mounting portion of the printer to which the printer component is to be attached.

When installed correctly, a toe-heel-type printer component installation provides a particularly accurate, reliable, and durable connection between the printer component and its related mounting portion. This term originates from the similar appearing procedure for putting a conventional ski boot in a ski binding. Namely, the skier first places their toe in a front binding on a ski then steps down on the ski to secure a rear binding around the heel portion of the boot. In general, a traditional toe-heel printer component installation includes first operably securing a toe-end portion of the printer component into appropriate mounts received toward the front of the mounting portion, then snapping the back-end of the printer component into appropriate mounts received toward the back of the mounting portion.

Despite the benefits of traditional toe-heel printer component mounts, they offer several drawbacks. For example, the toe-end portion of the printer component must be installed first, a concept that is not necessarily intuitive to most users of printers. If an installer erroneously installs the back-end of the printer component, the toe-end will not likely be secured to its appropriate mounts, usually resulting in the printer component not operating. Moreover, after first improperly securing the back-end of the printer component to the mounts in the component mounting portion, some users may attempt to use excessive force to make the toe-end engage its mounts. Such force often results in premature wear or breakage of the printer component.

SUMMARY OF THE INVENTION

Accordingly, despite the available improvements offered by traditional toe-heel printer component mounts, there remains a need for a simple and economical device for ensuring that an installer will easily recognize and follow proper toe-heel installation of a detachable printer component. In addition to other benefits that will become apparent in the following disclosure, the present invention fulfills these needs.

The present invention is a partial mounting portion cover that extends above and partially over the front portion of the chamber in which the printer component is to be installed. The cover includes a substantially planar top surface positioned over the portion of the chamber receiving the toe-end of the printer component. The planar top surface is positioned above the printer component when the printer component is fully installed on the mounting portion, and it extends over the printer component only by an amount that precludes it from interfering with the toe-heel installation previously described.

Accordingly, so long as the installer performs a toe-heel installation of the detachable printer component, the mounting portion cover does not interfere with the installation. However, if an installer attempts to install the printer component in another manner besides using the toe-heel installation process, the cover blocks the toe-end of the printer component from entering the chamber, thereby alerting the installer of the improper installation. Moreover, the cover also serves as a visual obstacle to the installer, thereby suggesting that the toe-end must first be inserted below the cover before attempting to install other portions of the printer component. In a preferred embodiment, the cover is a visually distinguishable color from the mounting portion, further highlighting the visual benefits of this device.

More preferably, the cover is pivotally secured to the mounting portion at a pivot point by arms that extend from the substantially planar top surface to the mounting portion, and at least one beam spring extends from the substantially planar top surface to operably engage the mounting portion, thereby biasing the cover to a neutral position. The beam spring and pivot point allow the substantially planar top surface to deflect slightly upward during proper toe-heel installation, thereby facilitating the toe-end of the printer component into the appropriate area of the mounting portion. The leading edge of the substantially planar top surface may be angled upward to further facilitate entry of the toe-end of the printer component below the cover.

DETAILED DESCRIPTION

An inkjet printer 20 having a partial mounting portion cover 180 that extends above and partially over the front portion of the mounting chamber in which a detachable printer component, such as an ink reservoir, is installed is shown in FIGS. 1–13.

A. General Assembly

Figure 1:
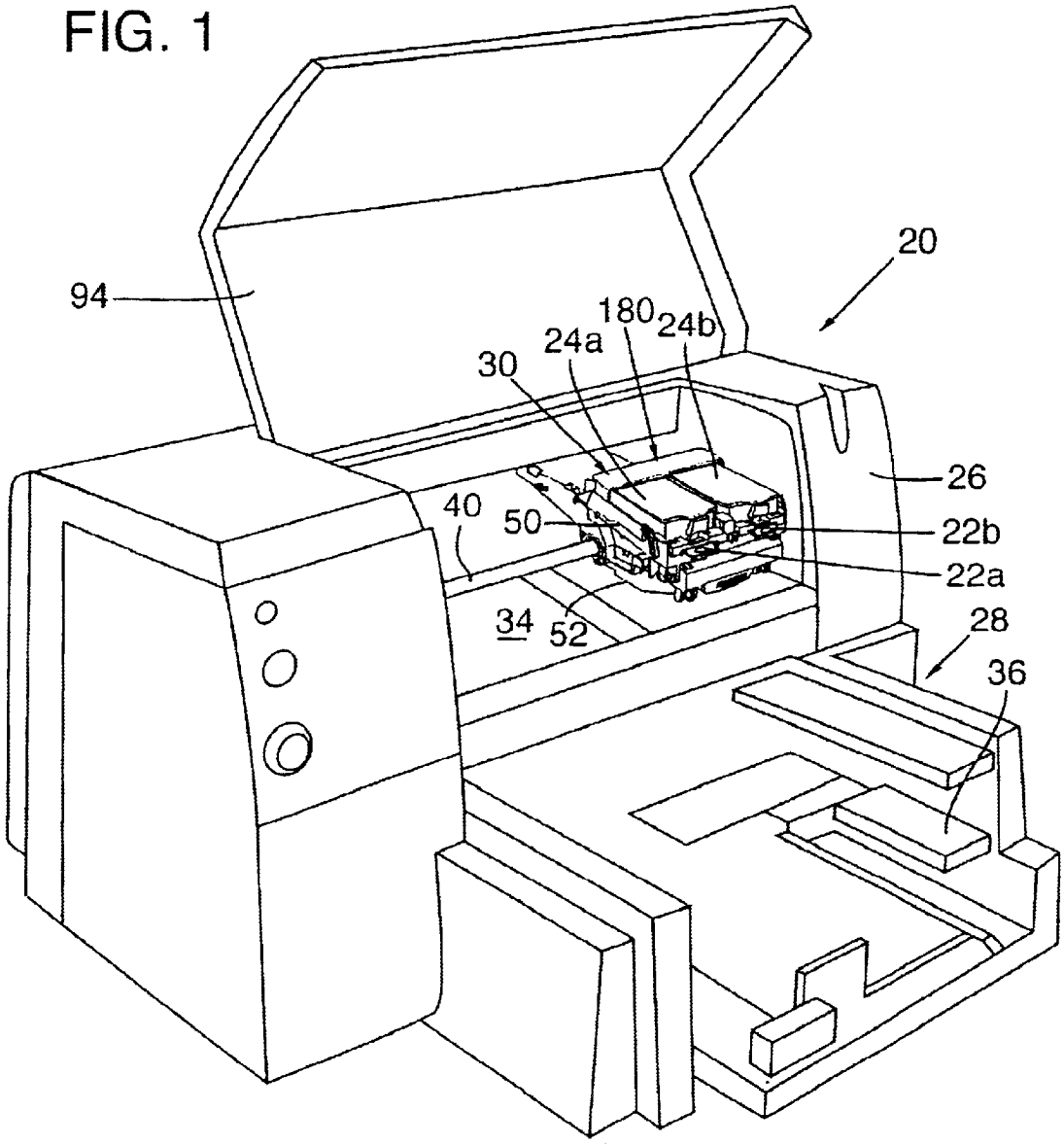
FIG. 1 is a simplified perspective view of an inkjet printer having a carriage in accordance with a preferred embodiment of the present invention.

FIG. 1 illustrates an embodiment of an inkjet printing mechanism, here shown as an inkjet printer 20, constructed in accordance with the present invention, which may be used for printing business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of the present invention are illustration in the environment of an inkjet printer 20.

While it is apparent that the printer components may vary from model to model, the typical inkjet printer 20, shown in FIG. 1, includes a chassis 26, a print medium handling system 28 for supplying sheets of print media to the printer 20, and a movable print carriage 30 for moving printheads 32 relative to the print medium at a print zone 34. The print media may be any type of suitable sheet material, such as paper, card-stock, transparencies, mylar, foils, and the like, but for convenience, the illustrated embodiment is described using paper as the print medium. The print medium handling system 28 moves the print media into a print zone 34 from a feed tray to an output tray 36, for instance, using a series of conventional motor-driven rollers (not shown).

In the print zone 34, the media sheets receive ink from a printhead 32. Each printhead 32 has bottom surface 38 comprising an orifice plate with a plurality of nozzles formed therethrough in a manner well known to those skilled in the art. The illustrated printheads 32 are thermal inkjet printheads, although other types of printheads may be used, such as piezoelectric printheads. The printheads 32 typically include a plurality of resistors which are associated with the nozzles. Upon energizing a selected resistor, a bubble of gas is formed ejecting a droplet of ink from the nozzle and onto a sheet of paper in the print zone 34 under the nozzle.

The printheads 32 are transported by the carriage 30, which may be driven by a conventional drive belt/pulley and motor arrangement (not shown) along a guide rod 40. The guide rod 40 defines a scanning direction or scanning axis along which the printheads 32 traverse over the print zone 34. The printheads 32 selectively deposit one or more ink droplets on a print media page located in the print zone 34 in accordance with instructions received via a conductor strip from a printer controller (not shown), such as a microprocessor which may be located within chassis 26. The controller may receive an instruction signal from a host device, which is typically a computer, such as a personal computer. The printhead carriage motor and the paper handling system drive motor operate in response to the printer controller, which may operate in a manner well known to those skilled in the art. The printer controller may also operate in response to user inputs provided through a keypad. A monitor coupled to the host computer may be used to display visual information to an operator, such as the printer status or a particular program being run on the computer. Personal computers, their input devices, such as a keyboard and/or a mouse device, and monitors are all well known to those skilled in the art.

In particular, the print medium is fed from print media input stack in input tray through a print medium feed mechanism (not shown). The print medium is then advanced by rollers (not shown) in a direction perpendicular to a guide rod 40, while the print carriage 30 containing printheads 32 is moved back and forth on guide rod 40. Preferably, and shown in FIG. 2, the carriage 30 contains at least one printhead 32*a* and at least one detachable ink reservoir 24*a* in fluid communication with that printhead 32*a*. More preferably, the ink reservoir 24*a* is on-axis, both ink reservoir 24*a* and the printhead 32*a* are detachably secured to the carriage 30 at respective mounting portions 50, 52, and at least one of these mounting portions 50, 52 includes a separable key element 22*a*, 22*b* for ensuring that the proper printer components are inserted into the proper mounting bases 50, 52.

B. Carriage Assembly—On—Axis Ink Reservoirs

Figure 2:
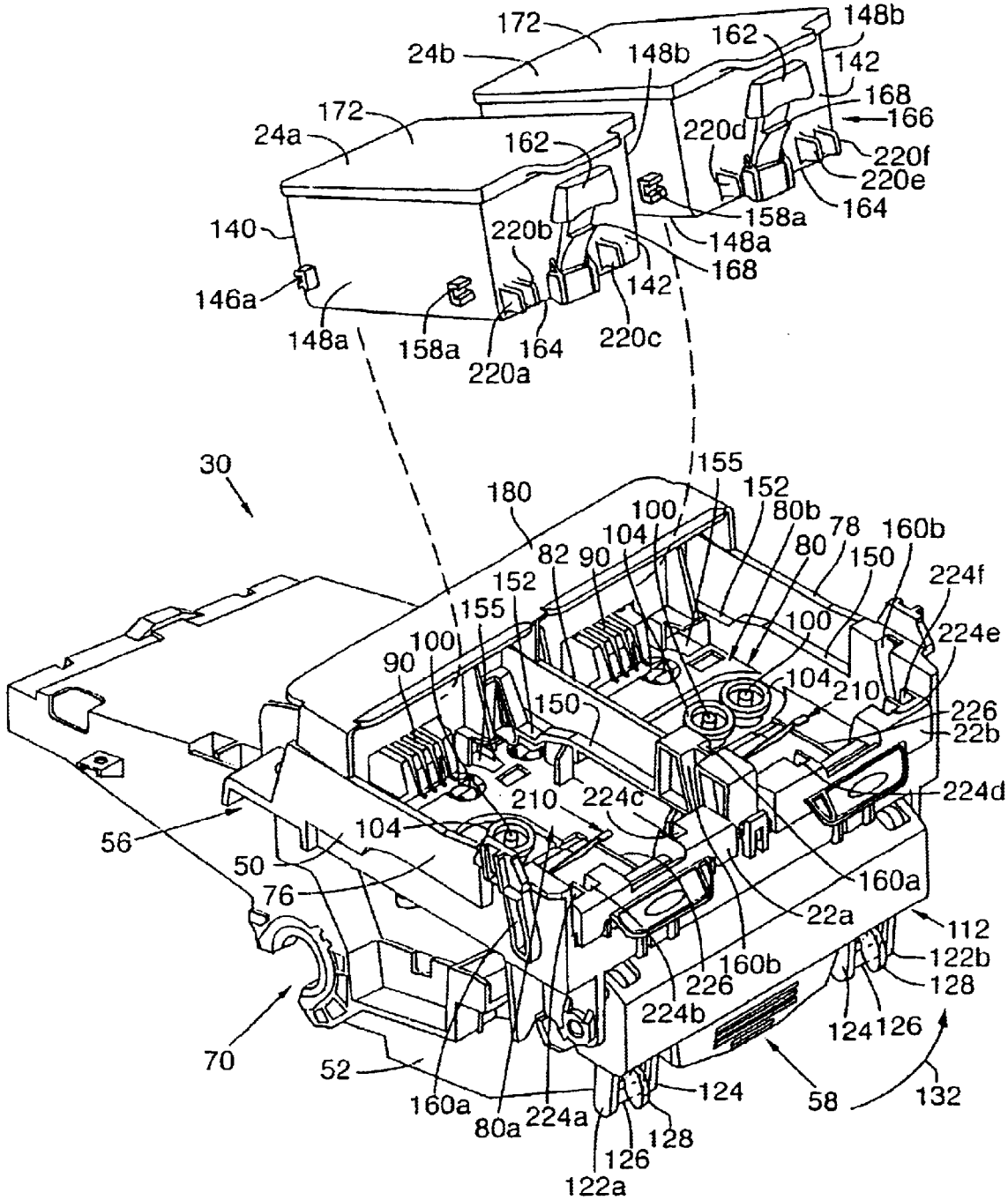
FIG. 2 is an enlarged and exploded isometric view of the carriage of FIG. 1.
Figure 12:
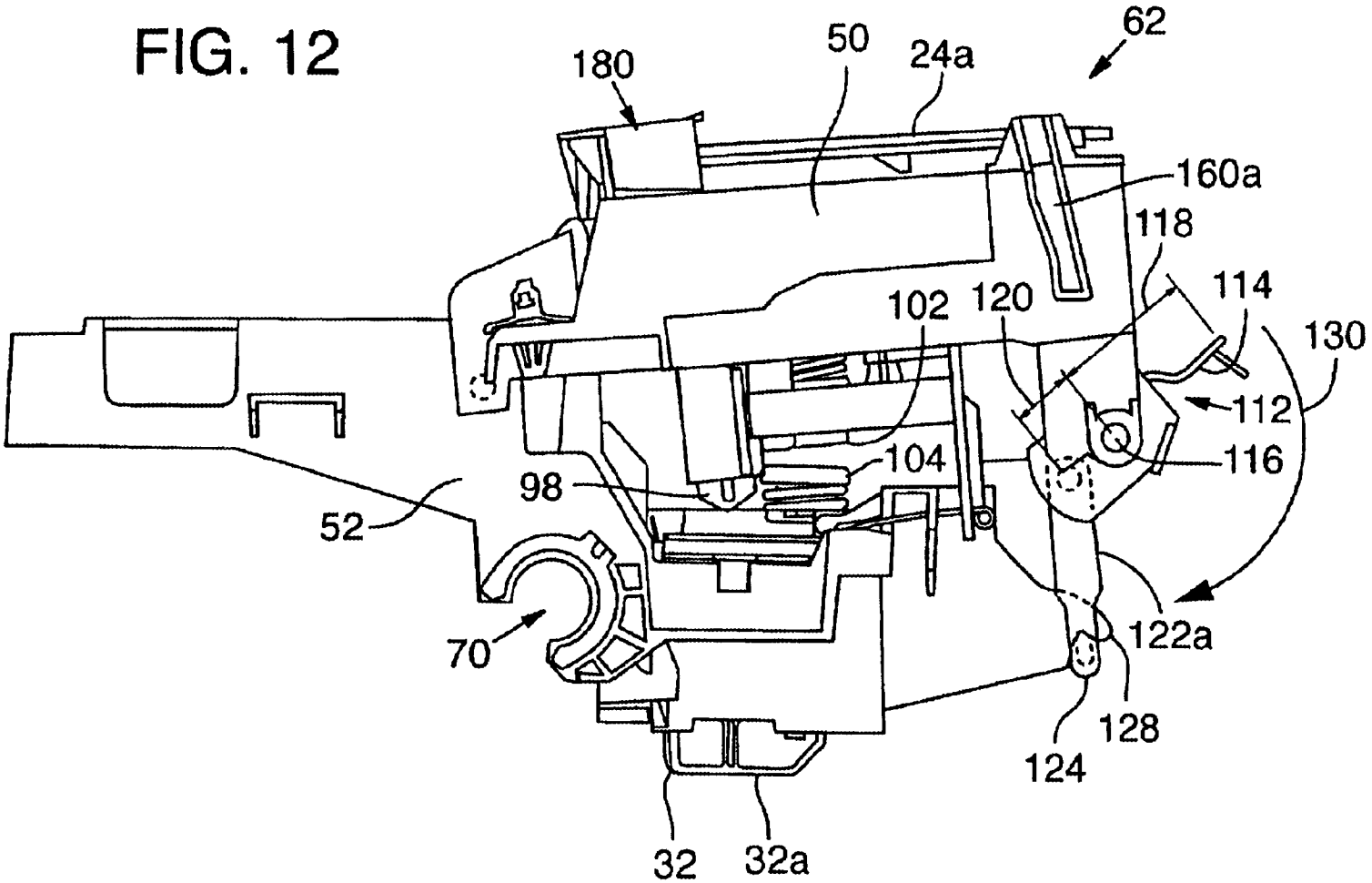
FIG. 12 is a side view of the carriage of FIG. 2 showing a possible unlatched position of the carriage.
Figure 13:
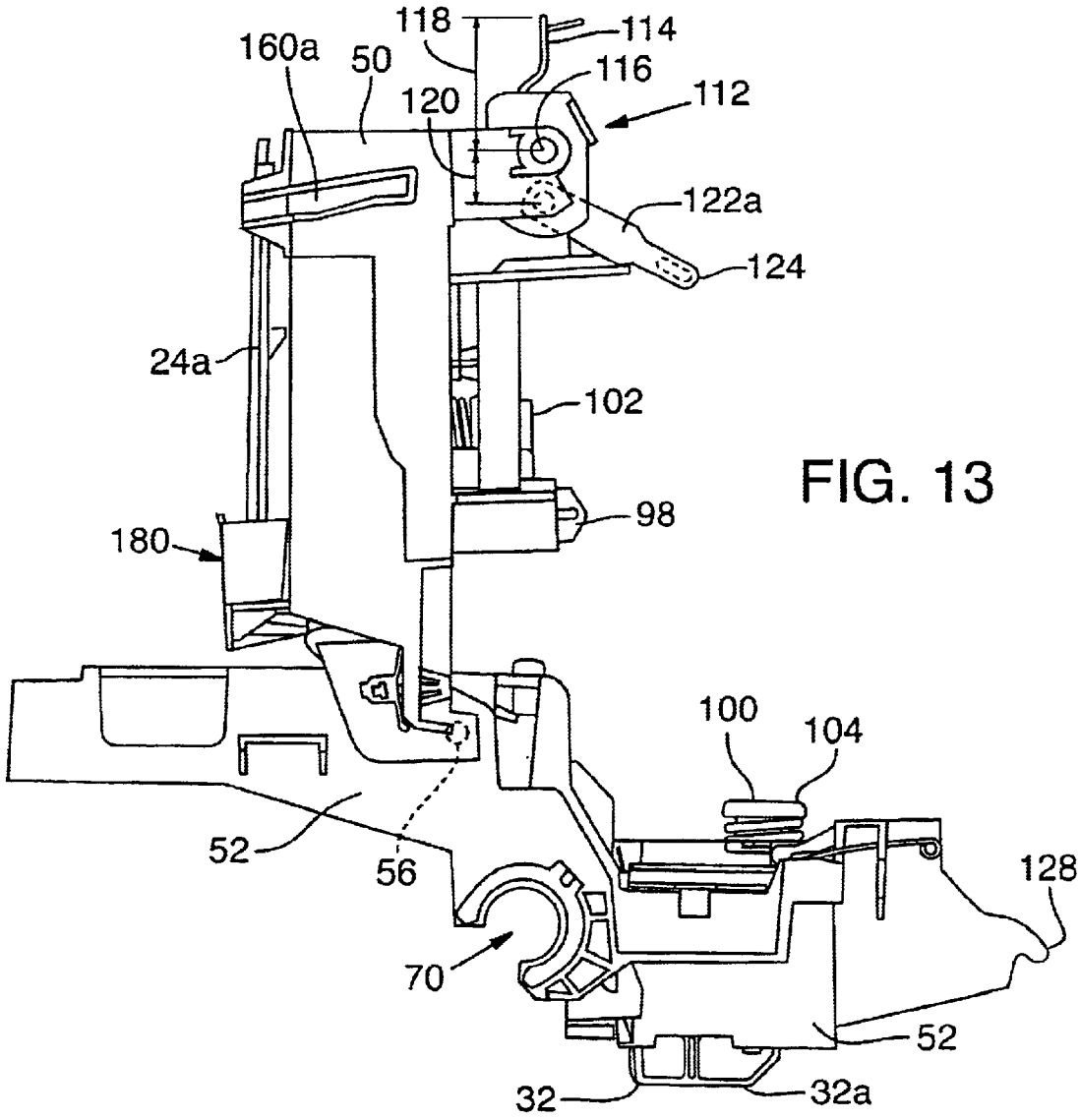
FIG. 13 is a side view of the carriage of FIG. 2 showing a possible open position of the carriage.

As best shown in FIGS. 2, 9, 12, and 13, the carriage 30 preferably includes an ink reservoir-mounting portion 50 pivotally secured to a printhead mounting-portion 52 at pivot point 56 defining an engaged position 58 of the ink reservoir-mounting portion 50 relative to the printhead mounting-portion 52 shown in FIG. 2, an open position 60 shown in FIG. 13, and an unlatched position 62 shown in FIG. 12.

Figures 9, 10, 11:
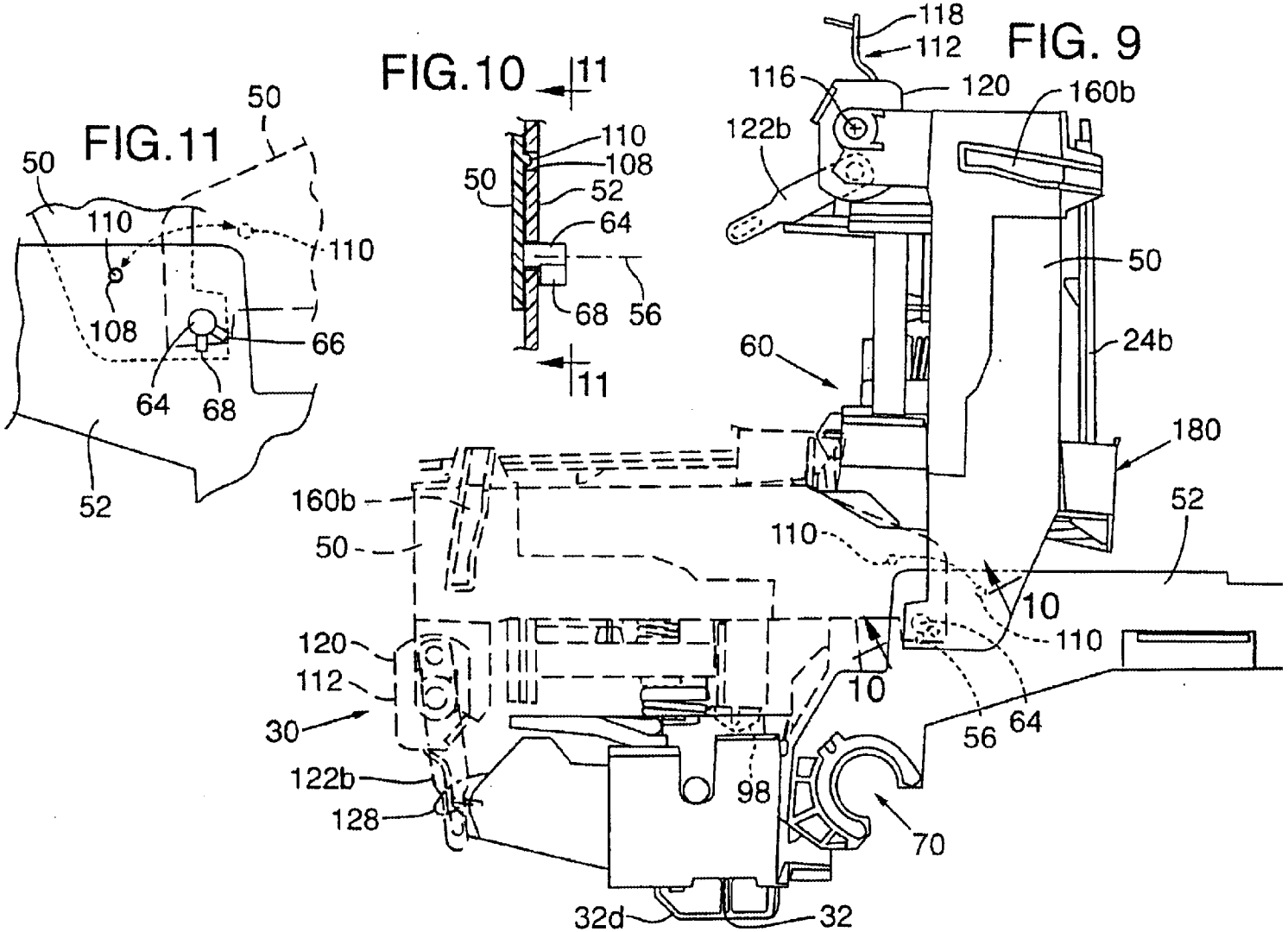
FIG. 9 is a side view of the carriage of FIG. 2.
FIG. 10 is an enlarged, fragmentary view of the carriage of FIG. 9 along line 10—10 of FIG. 9.
FIG. 11 is an enlarged, fragmentary view of the carriage of FIG. 9 taken along line 11—11 of FIG. 10 showing a closed position in solid lines and a possible open position in broken lines.

One known way to pivotally secure these mounting portions 50, 52 together includes extending a shaft 64 from the pivot point 56 on one of the mounting portions 50, 52 into a mating hole received on the other of the mounting portions 50, 52. As best shown in FIGS. 10 & 11, the mating hole preferably includes a notched tab 66 sized to receive a mating end portion 68 of the shaft 64 only when the ink reservoir-mounting portion 50 is at a defined position relative to the printhead mounting-portion 52. Such an orientation allows a worker to quickly assemble these mounting portions 50, 52 together by positioning the mating end portion 68 of the shaft 64 through the notched tab 66. Moreover, once assembled, the mating end portion 68 serves to keep these two mounting portions 50, 52 together during operation of the assembled product.

The printhead mounting-portion 52 includes a guide rod-engaging portion 70 for operably engaging the guide rod 40 and the printhead mounting-portion 52 for operably receiving at least one detachable printhead 32 therein. Preferably, the carriage 30 shown in FIGS. 2, 9, 12, and 13 is sized to receive four printheads 32*a–d* (only printheads 32*a*, 32*d* are shown in the figures) so that it can print in a plurality of colors such as black, cyan, magenta and yellow. Each of the printheads 32*a–d* is in electrical communication with the printer controller to engage when commanded by the printer controller.

The ink reservoir-mounting portion 50 is sized and shaped to operably receive at least one detachable ink reservoir 24*a*, 24*b* therein. In particular, the ink reservoir-mounting portion 50 preferably includes a forward flange 72, rearward flange 74, left flange 76, and right flange 78 defining an ink reservoir chamber 80 therein. More preferably, the ink reservoir-mounting portion 50 includes at least one internal flange 82 defining a plurality of ink reservoir chambers 80*a*, 80*b* therein. The carriage 30 shown in FIGS. 2, 9, 12, and 13 is sized to receive at least two different detachable ink reservoirs 24*a*, 24*b* therein, a left ink reservoir 24*a* and a right ink reservoir 24*b*. One of the ink reservoirs, ((here the right ink reservoir 24*b*) preferably includes a plurality of ink chambers therein, thereby allowing it to store up to three different colors of ink. The other ink reservoir (here the left ink reservoir 24*a*) preferably includes a larger volume of a single color of ink. Accordingly, it can be filled with the most frequently used color of ink, which is usually black.

The chambers of ink in the detachable ink reservoirs 24*a*, 24*b* are in fluid communication with their respective printheads 32*a–d* and in electrical communication with the printer controller when the ink reservoirs 24*a*, 24*b* and printheads 32*a–d* are properly installed in the carriage 30 and the ink reservoir-mounting portion 50 and the ink reservoir-mounting portion 50 is in the engaged position 58 (FIG. 2). In particular, each ink reservoir 24*a*, 24*b* preferably includes a conductive electrical connector engaging portion (not shown) positioned to operably engage a corresponding electrical connector 90 when the ink reservoirs 24*a*, 24*b* are seated into their respective ink reservoir chambers 80*a*, 80*b*. Similarly, fluid channels 92 extend from openings (not shown) in the ink reservoirs 24*a*, 24*b* through the ink reservoir-mounting portion 50 to their respective printheads 32*a–d* when the ink reservoir-mounting portion 50 is in the engaged position 58.

1. Printhead Access

The pivoting connection between the ink reservoir-mounting portion 50 and the printhead mounting-portion 52 permits easy access to the printheads 32*a–d* for maintenance, service, or replacement. In particular, the carriage 30 can be positioned along the guide rod 40 to permit easy access to the carriage 30 through an access door 94 (FIG. 1) in the chassis 26 of the printer 20.

With the carriage 30 so positioned, the servicer lifts the ink reservoir-mounting portion 50 causing it to pivot about pivot point 56 and move to the open position 60, thereby exposing the printhead mounting-portion 52 and providing access to the printheads 32*a–d*.

Preferably, the ink supply from the ink reservoirs 24*a*, 24*b* to the printheads 32*a–d* is stopped when the carriage 30 is not in the engaged position 58 (FIG. 2). One known way to accomplish this is to maintain a substantially air tight seal between the ink reservoirs 24*a*, 24*b* and their respective printheads 32*a–d* when the carriage is in its engaged position 58 (FIG. 2). Accordingly, ejecting ink from the printheads 32*a–d* creates a vacuum in the fluid channels 92 that draws new ink from the ink reservoirs 24*a*, 24*b* into the channels. The substantial vacuum is broken when the carriage is moved out of its engaged position. Accordingly, no fluid flows through the channels 92 when the carriage is out of its engaged position.

Preferably, a rod 98 is positioned adjacent to each channel 92 and operably extends from the ink reservoir-mounting portion 50 to the printhead mounting-portion 52. As best shown in FIGS. 9 and 12, each rod 98 is biased to an extended position such that urging the ink reservoir-mounting portion 50 from its unlatched position 62 (FIG. 12) to its engaged position 58 (FIG. 2) causes each rod 98 to retract, thereby applying a force between the ink reservoir-mounting portion 50 and printhead mounting portion 52. This force facilitates maintaining the printheads 32*a–d* on the current datums.

Preferably, the fluid cannels 92 include interlocking nozzles 100 and mating recesses 102 on the ink reservoir-mounting portion 50 and the printhead mounting-portion 52 that interlock together when the ink reservoir-mounting portion 50 is in the engaged position 58 (FIG. 2), thereby allowing fluid to flow through the fluid channels 92 and making the connections substantially air tight. More preferably, retractable seals 104, that are biased to an extended position operably engage each nozzle 100 and mating recess 102 connection when the ink reservoir-mounting portion 50 is in its engaged position 58, thereby preventing inadvertent leaking of air into the ink channels. Filters (not shown) are also preferably placed in the fluid path at these connections, thereby preventing inadvertent contamination the printheads 32*a–d*.

As best shown in FIG. 10, in order to prevent the ink reservoir-mounting portion 50 from inadvertently falling out of its open position 60 during maintenance, a resistive detent 108 may be positioned in one of the ink reservoir-mounting portion 50 or the printhead mounting-portion 52. The resistive detent 108 operably engages a tab 110 extending from the other of the ink reservoir-mounting portion 50 or the printhead mounting-portion 52 when the ink reservoir-mounting portion 50 is in its open position 60, thereby holding the ink reservoir-mounting portion 50 in place.

2. Carriage Latching Mechanism

Preferably, a latching mechanism 112 is provided to secure the ink reservoir-mounting portion 50 in its engaged position 58 (FIG. 2). Moreover, because of the relatively large forces associated with deflecting the rods 98 of the spring-loaded plungers out of their neutral positions, it is desirable that the latching mechanism 112 operate as a lever, thereby minimizing the amount of force required by a user to secure the lever. As best shown In FIG. 12, the latching mechanism 112 preferably includes a handle 114 pivotally secured to the ink reservoir-mounting portion 50 at a pivot 116 such that the handle 114 defines a lever arm 118 on one side of the pivot 116 and a moment arm, 120 on the other side of the pivot 116. A left and right joining arm 122*a*, 122*b*, respectively, are pivotally secured to the moment arm 120 at a point spaced apart for the pivot 116. The opposite ends 124 of the joining arms 122*a*, 122*b* include openings 126 for receiving hooks 128 extending from the printhead mounting-portion 52.

As best shown in FIG. 12, to place the ink reservoir-mounting portion 50 in its engaged position 58, from its unlatched position 62 (FIG. 11), the user positions the openings 126 on the joining arms 122*a*, 122*b* over the hooks 128 extending from the printhead mounting-portion 52. The user then moves the lever arm 118 of the handle 114 in the direction of arrow 130 (FIG. 12). This action urges the ink reservoir-mounting portion 50 to pivot about the pivot 116 toward the printhead mounting-portion 52, drawing these two portions together. As the point where the left and right joining arm 122*a*, 122*b* pivot about the moment arm 120 rotates above and past a vertical plane aligned along pivot 116, the forces urging the mounting portions 50, 52 apart actually lock these components together, further defining the engaged position 58 of the ink reservoir-mounting portion 50.

To release the ink reservoir-mounting portion 50 from its engaged position 58, a user simply lifts the lever arm 118 of the handle 114 in the direction of arrow 132 (FIG. 2). When the point where the left and right joining arms 122*a*, 122*b* contact the moment arm 120 crosses back over the vertical plane extending from pivot 116, the forces acting on the ink reservoir-mounting portion 50 urge the ink reservoir-mounting portion 50 into the unlatched position 62 of FIG. 12.

C. Detachable Printer Component Installation

Preferably, the printer 20 includes one or more devices to facilitate and ensure that the detachable printer components, such as the ink reservoirs 24*a*, 24*b*, are properly installed, seated and aligned in their appropriate mounting portions 50, 52.

1. "Toe-Heel" Mounting Portion Cover

Detachable printer components, such as the ink reservoirs 24*a*, 24*b* of the present embodiment, can be installed into the ink reservoir-mounting portion 50 through a "toe-heel" installation mechanism and procedure. To facilitate understanding of this installation process in a printer 20, the following example is offered for the ink reservoirs 24*a*, 24*b* of the present invention. It should be appreciated by those skilled in the art that the principles of this procedure would work equally well with any other type of removable printer component, such as a traditional ink/printhead cartridge, printhead 32, or an off-axis mounted ink reservoir.

In particular, the ink reservoirs 24*a*, 24*b* each have a defined shape, such as rectangle defining a leading, toe end 140 and a rearward-mounting end 142. The ink reservoirs 24*a*, 24*b* are slightly smaller than the shape of their corresponding ink reservoir chambers 80*a*, 80*b*. Left and right toe-end guides 146*a*, 146*b* (only 146*a* is shown) extend from the left and right sides 148*a*, 148*b* of each ink reservoir 24*a*, 24*b*, and slidably engage guide rails 150 aligned along the respective left and right sides 148*a*, 148*b* of the corresponding ink reservoir chambers 80*a*, 80*b*, the guide rails 150 lead to toe-end guide receptacles 152 toward the rear end 154 of the ink reservoir chambers 80*a*, 80*b* for operably securing the toe-end guides 146*a*, 146*b* therein. Front tabs (not shown) extend from the ink reservoirs 24*a*, 24*b* to operably engage mating tab mounting chambers 155 received in the ink reservoir chambers 80*a*, 80*b*.

The rearward-mounting end 142 of the ink reservoirs 24*a*, 24*b* preferably includes left and right rearward mounting end guides 158*a*, 158*b* sized to slidably engage respective mating slots 160*a*, 160*b* received on the respective side walls of the ink reservoir chambers 80*a*, 80*b*. A lever 162, operably secured toward the lower portion 164 of the rearward-mounting end 142 of the ink reservoirs 24*a*, 24*b* is biased to an extended position 166 (shown in FIG. 2). The lever 162 includes a notch 168 extending therefrom for operably engaging a lip 170 (FIG. 5) on the forward flange 72 of the ink reservoir-mounting portion 50, thereby detachably securing the ink reservoirs 24*a*, 24*b* to the ink reservoir mounting-portion 50.

Each ink reservoir 24*a*, 24*b* is installed into its respective ink reservoir chamber 80*a*, 80*b* by the installer first placing the toe end 140 into the respective ink reservoir chamber 80*a*, 80*b* such that the left and right toe-end guides 146*a*, 146*b* slidably engage guide rails 150. The user slides the toe end 140 of the ink reservoir 24*a*, 24*b* toward the toe-end guide receptacles 152. When the toe-end guides 146*a*, 146*b* are seated in their respective receptacle 152, the user then presses down on the upper surface 172 of the ink reservoir 24*a*, 24*b* toward the rearward-mounting end 142, causing the left and right rearward mounting end guides 158*a*, 158*b* to slidably engage their respective mating slots 160*a*, 160*b*, and thereby properly positing the ink reservoirs 24*a*, 24*b* into their respective ink reservoir chambers 80*a*, 80*b*.

As best shown in FIG. 2, to encourage proper installation of the detachable printer component as described, a mounting portion cover 180 that extends above and partially over the ink reservoir chambers 80*a*, 80*b* can be operably mounted to the ink reservoir-mounting portion 50. In particular, the cover 180 includes a substantially planar top surface 182 positioned over the ink reservoir chambers 80*a*, 80*b* receiving the toe end 140 of the ink reservoirs 24*a*, 24*b*. The planar top surface 182 is positioned above each ink reservoir 24*a*, 24*b* when each ink reservoir 24*a*, 24*b* is fully installed on the ink reservoir-mounting portion 50, and it that precludes it from interfering with the toe-heel installation previously described. Accordingly, as best shown in FIG. 5, so long as the installer performs a toe-heel installation of the detachable printer component, the mounting portion cover 180 does not interfere with the installation.

However, if an installer attempts to install an ink reservoir 24*a*, 24*b* in another manner besides using the toe-heel installation process, the cover 180 blocks the toe end 140 of the ink reservoir 24*a*, 24*b* from entering the respective ink reservoir chambers 80*a*, 80*b*, thereby alerting the installer of the improper installation. For example, if an installer would first attempt to secure the notch 168 extending from the lever 162 to the lip 170 on the forward flange 72, and then attempt to lower the toe end 140 of the ink reservoir 24*a*, 24*b* into the respective ink reservoir chamber 80*a*, 80*b*, the mounting portion cover 180 blocks the toe end 140 of the ink reservoir 24*a*, 24*b* from entering the respective ink chamber 80*a*, 80*b*, thereby alerting the installer of the improper installation method. Similarly, if the installer attempts insert an ink reservoir 24*a*, 24*b* into the ink reservoir chamber 80*a*, 80*b* simply by maintaining the bottom surface 190 of the ink reservoir parallel to the lower surface 192 of the respective ink reservoir chamber 80*a*, 80*b*, the mounting portion cover 180 blocks the toe end 140 of the ink reservoir 24*a*, 24*b* from entering into the respective ink reservoir chambers 80*a*, 80*b*.

Figure 5:
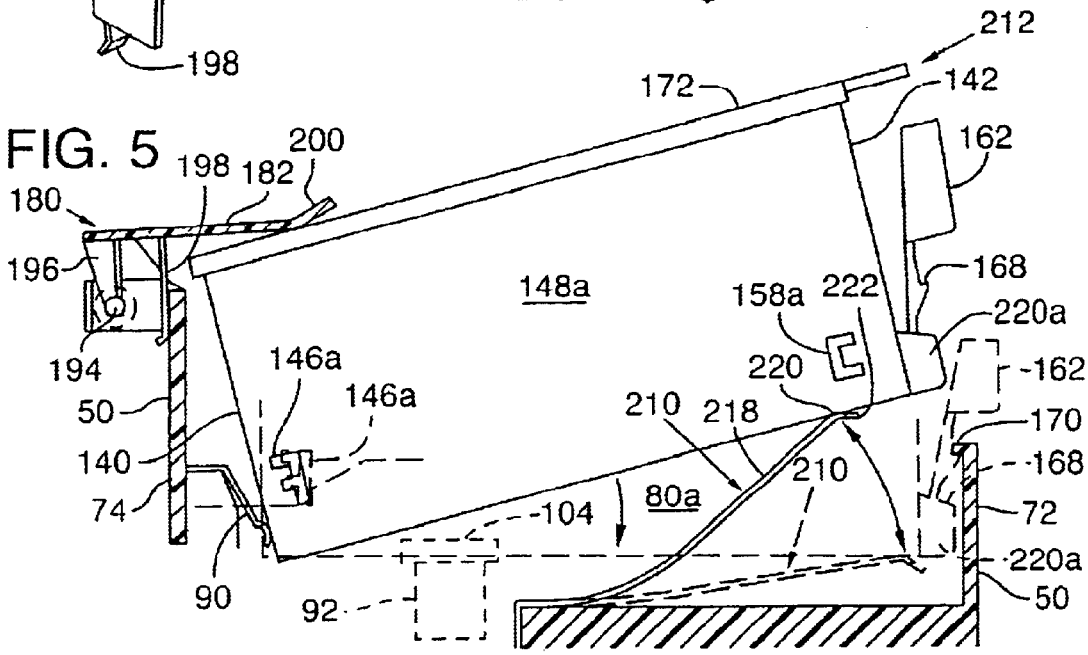
FIG. 5 is a fragmentary, side view of the carriage of FIG. 2 along line 5—5 of FIG. 2 with an uninstalled detachable ink reservoir shown and the same ink reservoir installed on the carriage shown in hidden lines.

More preferably, as best shown in FIG. 5, the cover 180 is pivotally secured to the ink reservoir-mounting portion 50 at pivot point 194 by arms 196 that extend from the substantially planar top surface 182 and at least one beam spring 198 extends from the substantially planar top surface 182 to operably engage the rearward flange 74 of the ink reservoir-mounting portion 50, thereby biasing the cover 180 to a neutral position shown in FIG. 2. The beam spring 198 and pivot point 194 allow the substantially planar top surface 182 to deflect slightly upward during the toe-heel installation process, but also urge the deflected substantially planar top surface 182 and the toe end 140 of the ink reservoir 24*a*, 24*b* in contact with it, toward the respective ink reservoir chamber 80*a*, 80*b*, thereby further facilitating installation of the ink reservoir. The leading edge 200 of the substantially planar top surface 182 may be angled upward as best shown in FIG. 5, to further facilitate entry of the toe end 140 of the ink reservoir 24*a*, 24*b* below the cover 180.

The cover 180 is preferably a contrasting color from the ink reservoir-mounting portion 50 and printhead mounting-portion 52 of the carriage 30. The contrast in color between these components makes the cover 180 appear more readily to an installer, thereby alerting the installer of this obstacle to improper installation of the ink reservoirs.

2. Helper Spring

As best shown in FIG. 5, a spring 210 is preferably operably secured within the ink reservoir chambers 80*a*, 80*b* to facilitate installation and remove of the ink reservoirs 24*a*, 24*b*. Preferably, the spring 210 biases each ink reservoir 24*a*, 24*b* to an uninstalled position 212 shown in solid lines in FIG. 5, but remains compressed while each respective ink reservoir 24*a*, 24*b* is latched in its installed position 214 shown in dashed lines in FIG. 5.

Figure 6:
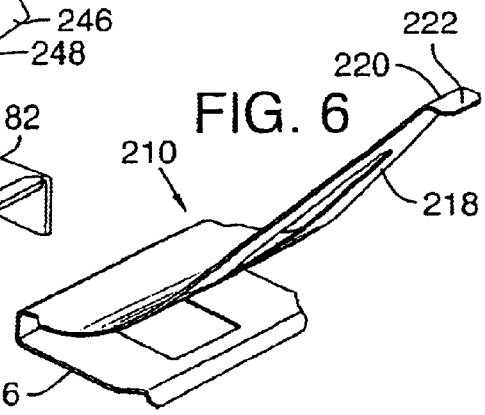
FIG. 6 is an enlarged, isometric view of a biasing spring in accordance with a preferred embodiment of the present invention.

One known effective spring design for such a purpose is a beam spring 210 shown in FIG. 6. The spring 210 includes a generally c-shaped mounting portion 216 and an elongate beam portion 218 extending therefrom. The distal end 220 of the beam portion 218 can include an angled end 222 aligned to support each ink reservoir 24*a*, 24*b* in its uninstalled position 212. The c-shaped mounting portion 216 is preferably clipped to an arm 224 extending from the ink reservoir-mounting portion 50 below each respective ink reservoir chamber 80*a*, 80*b*. Preferably, each ink reservoir chamber 80*a*, 80*b* includes a recess 226 for receiving the spring 210 when each respective ink reservoir 24*a*, 24*b* is in its installed position 214 within the respective ink reservoir chamber 80*a*, 80*b*.

Known preferable materials for constructing the spring 210 include high yield stainless steel and beryllium copper. The specific shape of the spring may be changed to optimize its force and displacement characteristics. A particularly effective beam shape is a triangle having a wide base toward the c-shaped mounting portion 216 that narrows at it approaches the distal end 220 of the spring. A similarly shaped portion of material may be removed from the beam portion as shown in FIG. 6, thereby further enhancing the force characteristics provided by the spring 210.

The spring 210 facilitates installation of each ink reservoir 24*a*, 24*b* by encouraging a toe-heel installation of each ink reservoir 24*a*, 24*b*. Preferably, with an ink reservoir 24*a* resting in the uninstalled position 212 of FIG. 5 and with the spring 210 unloaded, the toe end 140 of that ink reservoir 24*a* is properly aligned such that the left and right toe-end guides 146*a*, 146*b* are operably received within their respective toe-end guide receptacles 152. Moreover, the spring 210 facilitates easy removal of an ink reservoir 24*a* by urging the rearward-mounting end 142 of the ink reservoir 24*a* up when the lever 162 is unlatched.

Also, should an installer improperly latch the lever 162 as described, the spring 210 will urge the rearward-mounting end 142 of the ink reservoir 24*a* upward, thereby visually alerting the user of the improper installation. Preferably, the printer chassis 26 includes defined stops (not shown) that operably engage the rearward-mounting end 142 when the ink reservoir 24*a* is in its uninstalled position 212 shown in FIG. 5. The location of the carriage 30 when the rearward-mounting end 142 contacts these stops can then be used to signal the user of the improper ink reservoir 24*a* installation via a computer interface, warning light, or the like.

D. Separable Key Element

Preferably, the printer includes one or more separable key elements 22*a*, 22*b* as best shown in FIGS. 2, 3, 7 and 8.

In general, each detachable printer component, such as the ink reservoirs 24*a*, 24*b* shown in FIG. 2, includes a unique pattern of identifying tabs 220*a–f* extending therefrom. For example, the left ink reservoir 24*a* includes tabs 220*a–c*, two of which are to the left of the left ink reservoir's lever 162, and the right ink reservoir 24*b* includes tabs 220*d–f*, two of which are to the right of the right ink reservoirs lever 162. This pattern of tabs 220*a–f* can be used to indicate the type, color, and/or quality of ink contained that particular printer. For example, the tab pattern for the left ink reservoir 24*a* can indicate that it contains black ink, and the tab pattern displayed on the right ink reservoir 24*b* can indicate that the right ink reservoir is a multi-chamber reservoir containing blue, magenta, and yellow colored ink.

For a given printer 20, the correct location and orientation of the removable printer components are defined. For example, an ink reservoir containing black ink must be installed in an ink cartridge chamber that is in fluid communication with a black ink channel and related printhead. If a different color of ink were inadvertently placed in the channel and the corresponding printhead, these components would become contaminated and no longer function as designed. Accordingly, it is important that the correct ink supply be mounted in the correct ink chamber.

Each key element 22*a*, 22*b* includes a unique pattern of slots 224*a–f* to receive one of the available unique pattern of identifying tabs 220*a–f* therethrough, and preclude a different pattern of identifying tabs 220*a–f* from passing therethrough. The key element 22 is operably secured to the ink reservoir-mounting portion 50 adjacent to the space occupied by the tabs 220*a–c* on one of the ink reservoirs 24*a* when that ink reservoir 24*a* is in its installed position on the ink reservoir-mounting portion 50.

Figure 3:
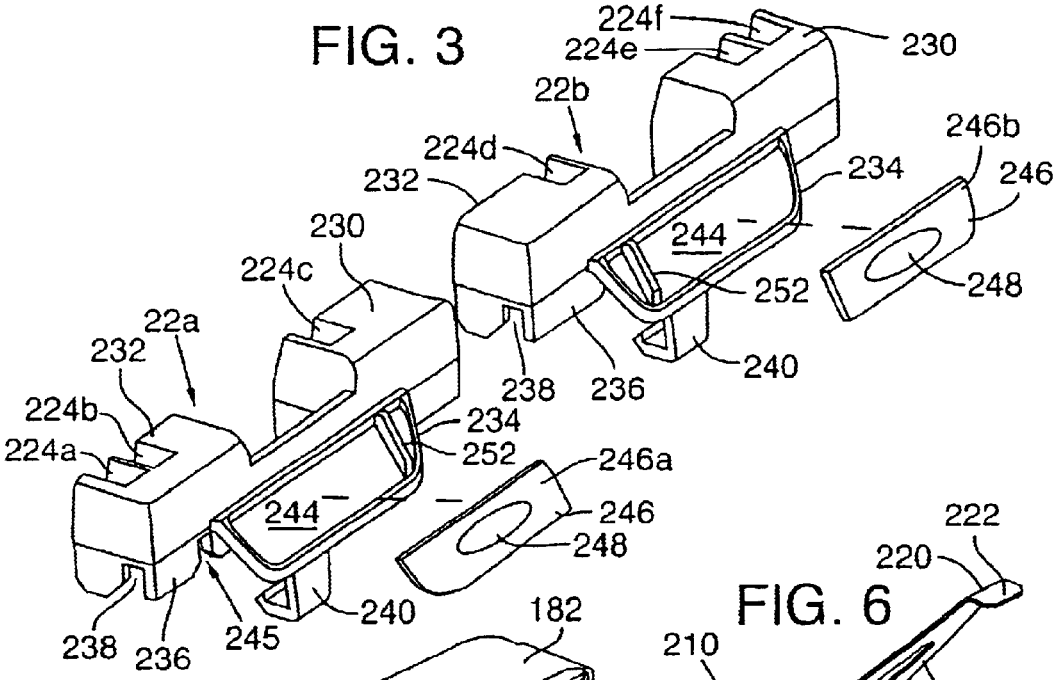
FIG. 3 is an enlarged, isometric view of first and second detachable key elements in accordance with a preferred embodiment of the present invention.
Figure 4:
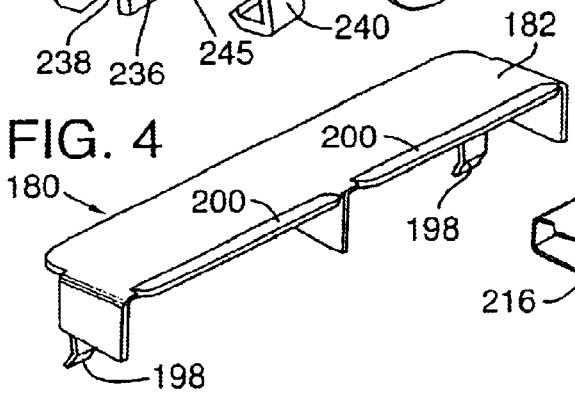
FIG. 4 is an enlarged, isometric view of a partial carriage cover in accordance with a preferred embodiment of the present invention.
Figure 7:
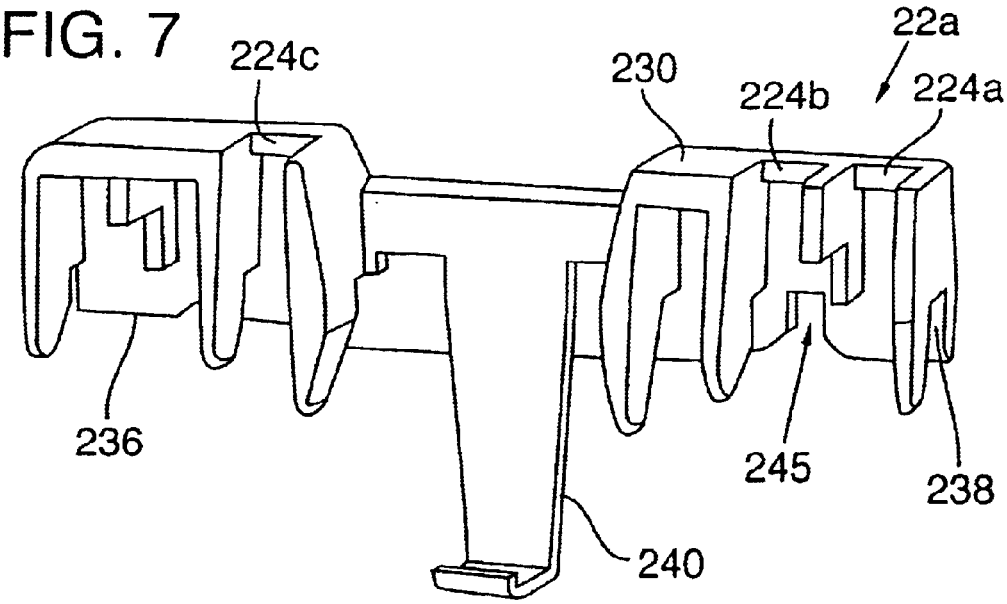
FIG. 7 is an enlarged, rear, isometric, view of the first separable key element of FIG. 3.
Figure 8:
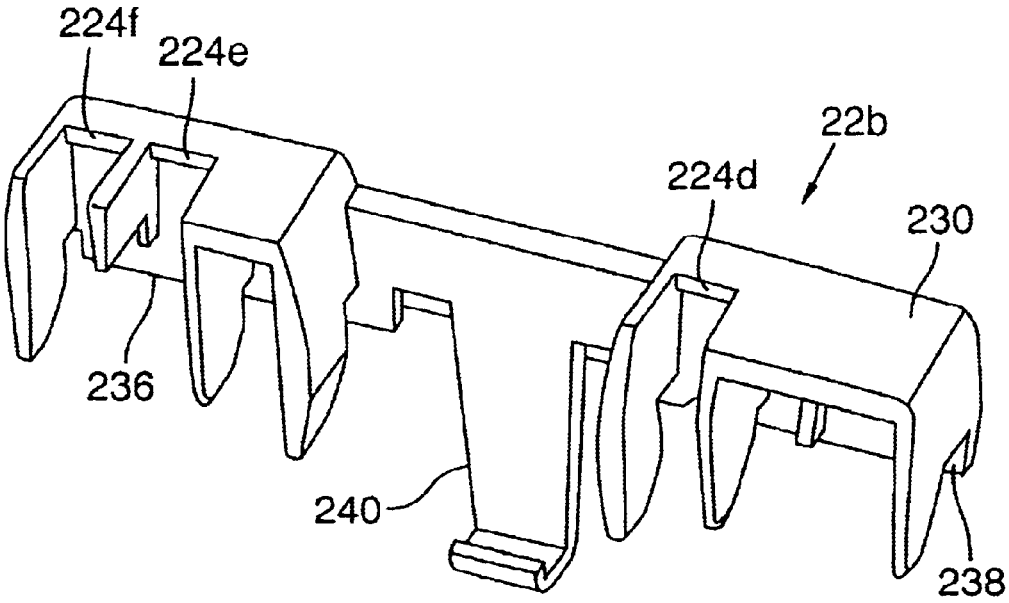
FIG. 8 is an enlarged, rear, isometric, view of the second separable key element of FIG. 3.

Preferably, and as best shown in FIGS. 3, 7, and 8, each key element 22*a*, 22*b* includes a base-mounting portion 230 having a key tab portion 232, an identifying label tab portion 234, and a mounting portion 236 extending therefrom. The mounting portion 236 includes a mounting slot 238 sized to be received on the forward flange 72 of the ink reservoir-mounting portion 50 and a hook 240 for operably engaging the forward flange 72. More preferably, the forward flange 72 and mounting portion 236 include a unique set of mating slots 245, thereby preventing an incorrect key element 22 from being installed at that particular location on the forward flange 72.

As best shown in FIG. 3, the label tab portion 234 includes a display surface 244 for receiving a label 246, preferably having unique surface indicia 248 thereon indicating the type of detachable printer component that the key element will accept. For example, one label 246*a* can indicate the key element 22*a* to which it is attached receives a black ink reservoir. Similarly, a separate key label 246*b* installed on a separate key element 22*b* can indicate that the key element 22*b* to which it is attached receives a multi-color ink reservoir.

Preferably, each display surface includes a unique shape or orientation. For example, the display surface 244 on one key element 22*b* can have a flat bar 252 on the left side of the display surface and a rounded right side, while the display surface 244 on another key element 22*a* may place the flat bar 252 on the right side and have a rounded left side. Accordingly, the likelihood that an assembler may place the wrong label 246*a*, 246*b*, on the display surface 244 is reduced, because the correct label for each display surface 244 can have the same shape corresponding to the display surface to which it is correctly attached.

The foregoing key elements 22*a*, 22*b* may be detachably secured to the printer 20. Accordingly, a family of printers can rely on the same basic carriage 30 and the like to build a variety of different printers having different functionality. Configuration control for a given printer installation is regulated by the manufacture selecting the appropriate key elements 22*a*, 22*b* for that particular printer configuration.

Moreover, should the manufacture, customer, or service technician ever wish to change the configuration of a printer, say for example, to convert a black and white printer into a color printer, or upgrade a printer with improved components, after the appropriate printer components are replaced to accommodate the new printer configuration the key elements 22*a*, 22*b* need only be changed in order to re-key the ink reservoir chambers to accept the new ink reservoirs.

E. Alternative Embodiments

Even though the foregoing description has focused on the installation and positioning of an ink reservoir in an ink reservoir mounting portion of a carriage, it can be appreciated that the basic concepts of this invention will work equally well with other detachable printer components such as printheads, ink/printhead cartridges, and the like. Thus, having here described preferred embodiments of the present invention, it is anticipated that other modifications may be made thereto within the scope of the invention by individuals skilled in the art. Thus, although preferred and alternative embodiments of the present invention have been described, it will be appreciated that the spirit and scope of the invention is not limited to those embodiments, but extend to the various modifications and equivalents as defined in the appended claims.

What is claimed is:

1. A mechanism for ensuring correct installation of a printhead into a printer comprising:

a detachable printhead having a top surface, a toe-end and a back end;

a mount having a toe-end engaging portion and a back end engaging portion, said toe-end engaging portion operably engaging the toe-end thereby pivotally securing said toe-end to said printer, said back end mounting portion operably engaging said back end when said toe-end is pivotally secured to said toe-end mounting portion and said printhead is pivoted about said toe-end toward said back end mounting portion;

a cover operably secured over said chamber and extending partially over said toe-end of said printhead when said detachable printhead is secured to said mount defining a neutral position of the cover with respect to the mount, said cover preventing said back end from operably engaging said back end engaging portion of said mount before said toe-end is pivotally secured to said toe-end engaging portion of said mount.

2. The mechanism for ensuring correct installation of a printhead of claim 1, wherein said printer is an inkjet printer.

3. The mechanism for ensuring correct installation of a printhead of claim 1, wherein said cover includes a substantially planar top surface having an angled leading edge lip for operably engaging the toe-end of said printhead during installation.

4. The mechanism for ensuring correct installation of a printhead of claim 1, wherein said cover is pivotally secured to said mount at a pivot point and able to deflect slightly out of the cover's engaged position to facilitate installation of said detachable printer component.

5. The mechanism for ensuring correct installation of a printhead of claim 4, wherein said cover is biased to said cover's neutral position.

6. The mechanism for ensuring correct installation of a printhead of claim 5, wherein said cover is biased to said cover's neutral position with a beam spring extending between said cover and said mount.

7. The mechanism for ensuring correct installation of a printhead of claim 1, wherein said cover is a visually distinguishable color from the color of said mount.

8. An inkjet printer comprising;

a chassis;

a motor;

a carriage operably secured to the chassis and driven by the motor for reciprocal movement relative to the chassis;

a detachable printhead having a top surface, a toe-end and a back end;

a mount having a toe-end engaging portion and a back end engaging portion, said toe-end engaging portion operably engaging the top-end thereby pivotally securing said toe-end to said printer, said back end mounting portion operably engaging said back end when said toe-end is pivotally secured to said toe-end mounting portion and said printhead is pivoted about said toe-end toward said back end mounting portion;

a cover operably secured over said chamber and extending partially over said toe-end of said printhead when said detachable printhead is secured to said mount defining a neutral position of the cover with respect to the mount, said cover preventing said back end from operably engaging said back end engaging portion of said mount before said toe-end is pivotally secured to said toe-end engaging portion of said mount.

9. The inkjet printer of claim 8, wherein said cover has an engaged position and is pivotally secured to said mount at a pivot point and able to deflect slightly out of the cover's engaged position to facilitate installation of said detachable printhead.

10. The inkjet printer of claim 8, wherein said cover is biased to said cover's neutral position.

11. The inkjet printer of claim 8, wherein said cover includes a substantially planar top surface having an angled leading edge lip for operably engaging the toe-end of said detachable printhead during installation.

12. A method for ensuring proper toe-heel insertion of a detachable printer component having a top surface, a toe-end and a back end into a mount on a printer, the mount operably engaging the toe-end and the back end of the detachable printer component, said method comprising the steps of:

providing a partial cover with a visually distinguishable color from the color of the mount;

positioning the partial cover over the mount such that the partial cover extends partially over the toe-end of the detachable printer component when the detachable printer component is secured to the mount;

first pivotally securing the toe-end of the detachable printer component to the mount by positioning the toe-end below the partial cover such that the top surface of the detachable printer component operably engages the partial cover and the toe-end is pivotally secured to the mount; and, then pivoting the detachable printer component about the toe-end to allow the back end to operably engage the mount thereby securing the detachable printer component to the mount.

13. The method for ensuring proper toe-heel insertion of a detachable printer component of claim 12, further including the step of blocking the toe-end of the detachable printer component from operably engaging the mount with the cover if the back end is secured to the mount before the toe-end is secured to the mount.

14. The method for ensuring proper toe-heel insertion of a detachable printer component of claim 12, wherein said detachable printer component is an ink reservoir.

15. The method for ensuring proper toe-heel insertion of a detachable printer component of claim 12, further including the step of biasing the cover to a neutral position.

16. The method for ensuring proper toe-heel insertion of a detachable printer component of claim 12, wherein the printer is an inkjet printer having a carriage, the detachable printer component is an ink reservoir, and the mount is operably secured to the carriage.

* * * * *